United States Patent [19]

Kalwar

[11] Patent Number: 4,841,409

[45] Date of Patent: Jun. 20, 1989

[54] METHOD OF MANUFACTURING A CORONA DISCHARGE ELECTRODE AND A CORONA DISCHARGE ELECTRODE PRODUCED BY THE METHOD

[76] Inventor: Klaus Kalwar, Alte Landwehr 10, 4803 Steinhagen, Fed. Rep. of Germany

[21] Appl. No.: 127,280

[22] Filed: Nov. 30, 1987

[30] Foreign Application Priority Data

Nov. 29, 1986 [DE] Fed. Rep. of Germany ..... 3640966
Nov. 29, 1986 [DE] Fed. Rep. of Germany ... 8632118[U]

[51] Int. Cl.[4] ..... H01T 19/04; F27B 9/04
[52] U.S. Cl. ..... 361/230; 250/324; 264/61
[58] Field of Search ..... 361/230; 264/61; 355/3 CH; 250/324, 325, 326

[56] References Cited

U.S. PATENT DOCUMENTS

| | | | |
|---|---|---|---|
| 2,843,646 | 7/1958 | Conant | 264/61 X |
| 3,163,753 | 12/1964 | Di Sabato et al. | 250/324 |
| 4,110,614 | 8/1978 | Sarid et al. | 250/326 X |
| 4,564,759 | 1/1986 | Tietje | 250/326 X |
| 4,696,778 | 9/1987 | Neil | 264/65 |

FOREIGN PATENT DOCUMENTS

| | | | |
|---|---|---|---|
| 33852 | 9/1978 | Japan | 250/325 |
| 165165 | 12/1981 | Japan | 355/3 CH |

*Primary Examiner*—Donald A. Griffin
*Attorney, Agent, or Firm*—Michael J. Striker

[57] ABSTRACT

A corona discharge electrode has a core made of a malleable, at least partially electrically conductive graphite material. The core is coated by a relatively thin layer of a dielectric material of an oxide free ceramic such as silicon nitrite, boron nitrite or aluminum nitrite. The density of the dielectric layer is at least 95% of the theoretically attainable density.

13 Claims, 2 Drawing Sheets

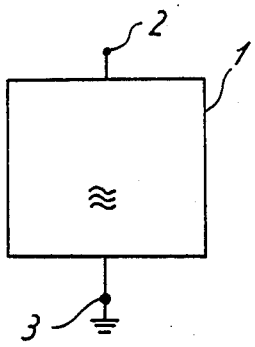
Fig. 1
Fig. 2
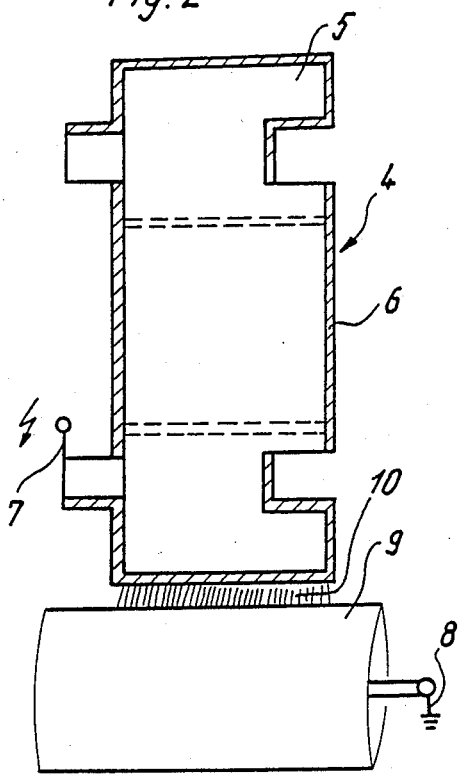
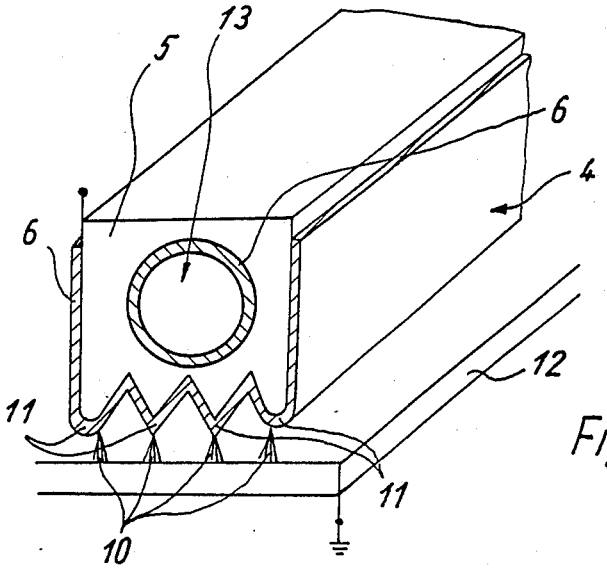
Fig. 3

METHOD OF MANUFACTURING A CORONA DISCHARGE ELECTRODE AND A CORONA DISCHARGE ELECTRODE PRODUCED BY THE METHOD

BACKGROUND OF THE INVENTION

The present invention relates to a method of manufacturing a corona discharge electrode, wherein an electrode core of at least partially electrically conductive material is coated with a dielectric layer. The invention also relates to a corona discharge electrode produced by the novel method.

It is known that adhesion of upper surfaces of materials is improved by the exposure to a corona discharge and in non-polar materials, for example the surface adhesion can be established only upon treatment by the corona discharge.

In order to perform such a surface treatment by means of a corona discharge it is necessary to provide a source of electric energy in the form of a high frequency, high AC voltage generator, and a corona discharge electrode energized by the generator and being provided with a dielectric coating on which during operation the desired corona discharge occurs.

In the course of surface treatment by means of conventional corona discharge electrodes, the dielectric layer which is important for a uniform distribution of the corona discharge, proved to be a weak point.

The corona discharge during the continuous surface treatment strains the dielectric layer of the electrode to a degree which depends on the particular production method. It has been proved that depending on the kind of the dielectric layer, a wear occurs after different time periods. The wear however, in each case takes effect with an undesired speed.

The following factors can be the cause of this wear:

Due to porosity of the dielectric material and due to the requirement for a-short-circuit safe structure of the dielectric layer the latter has hitherto been deposited with a relatively large thickness. Consequently, the efficiency of the known corona electrodes has been considerably impaired. Accordingly, due to the lower efficiency the conversion of electric corona to effective power per surface unit becomes disadvantageously low and also the obtained adhesion values of the treated material are lower.

This deficit can be compensated for only with an increased power of the generator and with increased size of the employed devices which conditions lead to excessive heat generation on the corona discharge electrode and to corresponding wear.

Altogether, the wear as well as the impaired efficiency during the surface treatment by the corona discharge due to the wear lead to increased manufacturing costs and to corruption of quality of the treated material.

SUMMARY OF THE INVENTION

It is therefore, a general object of the present invention to overcome the aforementioned disadvantages.

More particularly, it is an object of this invention to provide an improved method of manufacturing a corona discharge electrode which has only a minute susceptibility to wear and a high efficiency.

In keeping with these objects and others which will become apparent hereafter, one feature of the invention resides, in applying on an electrode core of graphite a dielectric layer of a predominantly non-oxide ceramic material.

By virtue of this particular combination of a graphite core with the dielectric layer of a non-oxide ceramic material, a relatively thin dielectric layer enables a non-porous coating having a high density so that even with very thin layers and with a point like permanent strain under the high frequency high voltage over several hours, a breakdown proof insulation is made possible as has been proved experimentally. The dielectric properties of the novel coating change with temperature and frequency changes only insignificantly.

Moreover, in corona discharged electrodes produced by the method of this invention it has been observed that the so-called corona ignition voltage is substantially lower whereby an improved efficiency is obtained.

In an advantageous further elaboration of the method of this invention, a malleable and heat conductive core material is used which has approximately the same temperature expansion coefficient as the dielectric material employed for the coating.

A corona discharge electrode produced according to the invention is characterized by a dielectric coating predominantly of non-oxide ceramic material applied with a density of at least 95 percent of the theoretically achievable density.

The entire dielectric layer is relatively thin and simultaneously guarantees a non-porous and dense coating of the core.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a schematic block diagram of a high voltage, high frequency generator for operating a corona discharge electrode;

FIG. 2 is a sectional side view of a corona electrode;

FIG. 3 is a perspective view of another embodiment of a corona electrode;

DESCRIPTION OF THE PREFERRED EMBODIMENTS

Figure 4:
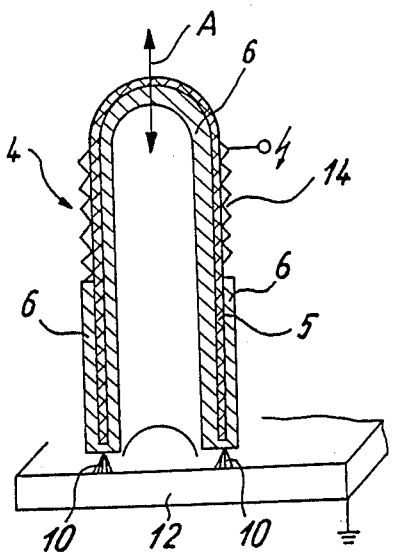
FIG. 4 is a sectional side view of still another embodiment of a corona electrode.

In FIG. 1, reference numeral 1 indicates a high voltage generator whose terminals 2 and 3 are connected during operation to corona discharge electrodes 4 illustrated in FIGS. 2 through 5.

Referring to FIG. 2, the corona discharge electrode 4 consists of a core 5 coated by a dielectric layer 6.

The core 5 consists of a malleable graphite material which has a good thermal conductivity and a temperature expansion coefficient which approximately equals to that of the dielectric 6.

The dielectric 6 consists predominanely of a non-oxide material, preferably of a ceramic material, such as boron nitrite, silicon nitrite or aluminum nitrite or of a mixture of these materials. Applicable is also a mixture of ceramic materials having non-oxide and oxide components.

The density of the dielectric coating 6 on the core 5 amounts at least to 95% of the theoretically attainable density.

The core 5 is coated by a physical vapor deposition (PVD-process) or by a chemical vapor deposition (CVD-process).

It is also possible to coat the core 5 with the dielectric by means of a sintering process or by a chemical reaction sintering. Applicable is also a plasma spraying process for depositing the dielectric on the core.

As long as boron nitrite is used exclusively for the dielectric coating, it is of advantage when the boron nitrite is in hexagonal, un-isotropic form.

The graphite core material which has a good heat conductivity and substantially the same temperature expansion coefficient as the dielectric material used for the coating has the advantage that no dilaminations occur in the interface of the two materials. In this manner, a corona discharge electrode which is safe against electric rupture is created.

The use of mixed ceramic materials for the dielectric ccating makes it possible to manufacture at low costs corona electrodes of high quality.

In general the dielectric layer 6 of the electrode 4 is relatively thin layer of the above described materials.

When high frequency, high voltage HF generator 1 is applied to terminal 7 of the electrode 4 and to terminal 8 of a counterelectrode which in this example has the form of a roller 9, a corona discharge 10 will result.

It will be seen from FIG. 2 that at locations for connecting a power supply cable to the core 5, there is no dielectric 6. Hence, there is the possibility to link together several electrodes 4 of the same configuration without the risk of a short circuit.

FIG. 3 illustrates an embodiment of a corona discharge electrode 4 whose core 5 is formed with discharge ribs 11 defining sharp edges. Lateral sides of the core and the ribs 11 are coated with the beforedescribed dielectric 6. The point-like corona discharge 10 takes place against a grounded metal plate 12 acting as a counterelectrode.

In this embodiment the core 5 is provided with a cooling bore 13 extending in the direction of its longitudinal axis. The inner surface is again coated with dielectric layer 6.

The corona discharge electrode 4 shown in FIG. 4 has a hollow core 5 open at the bottom. The dielectric layer 6 covers a lower part of the outer surface of the core, the bottom end surfaces and the entire inner wall of the core. The corona discharge 10 takes place between the bottom end surfaces of the core and the metal plate 12. The ventillation of the interior of the corona electrode 4 is performed in the direction of arrow A which is parallel to the direction of the corona discharge. The non-coated upper part of the jacket of the hollow core 5 is provided with an outer thread 14 for connection to a power source terminal.

Figure 5:
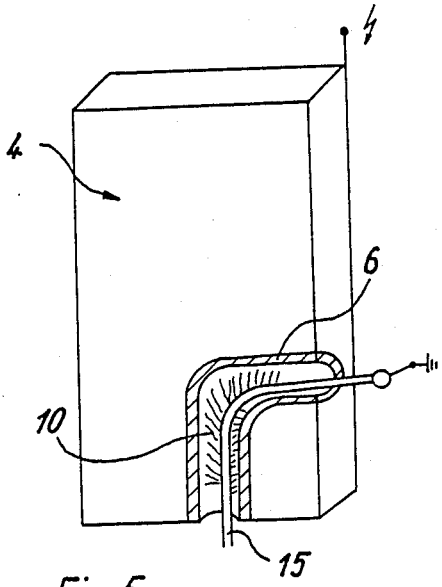
FIG. 5 shows in a partially cut-away view another modification of a corona discharge electrode.

FIG. 5 illustrates a corona discharge electrode 5 in the form of a prism provided with an inner corona discharge passage bent at an angle of 90°. The inner walls of the angular passage are coated with the dielectric layer 6 and a bent metal wire 16 is inserted into the passage and connected to the opposite terminal of the generator to be exposed to the resulting corona discharge 10.

While the invention has been illustrated and described as embodied in specific examples of corona discharge electrodes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. A corona discharge electrode comprising a core of at least partially electrically graphite material, a dielectric layer of a ceramic material coating at least a corona discharge surface of said core, said ceramic material being substantially of an oxide free ceramic having a density of at least 95% of theoretically attainable density.

2. A corona discharge electrode as defined in claim 1, wherein said ceramic material is selected from the group consisting of boron nitrite, silicon nitrite or aluminum nitrite.

3. A corona discharge electrode as defined in claim 2, wherein said ceramic material consists of a mixture of materials selected from the group consisting of boron nitrite, silicon nitrite or aluminum nitrite.

4. A corona discharge electrode as defined in claim 2, wherein said ceramic material includes boron nitrite in hexagonal, unisotropic form.

5. A corona discharge electrode as defined in claim 1, wherein said ceramic material consists of a mixture consisting predominantly of an oxide free component and of an oxide component.

6. A corona discharge electrode as defined in claim 1, wherein said core is made of a malleable graphite.

7. A corona discharge electrode as defined in claim 6, wherein said graphite core is a molded piece.

8. A method of manufacturing a corona discharge electrode, comprising the steps of preparing an electrode core of a graphite material, and depositing thereon by a chemical vapor-deposition process a dielectric layer of a ceramic material.

9. A method as defined in claim 8, wherein said ceramic material is selected from the group consisting of boron nitrite, silicon nitrite, and aluminum nitrite.

10. A method as defined in claim 9, wherein said boron nitrite is in hexagonal, unisotropic form.

11. A method as defined in claim 8, wherein said ceramic material includes a mixture of boron nitrite, silicon nitrite or aluminum nitrite.

12. A method as defined in claim 11, wherein said boron nitrite component is in hexagonal, unisotropic form.

13. A method as defined in claim 8, wherein said material of said dielectric layer consists of a mixture of oxide free components with oxide components.

* * * * *